US006259655B1

(12) United States Patent
Witort

(10) Patent No.: US 6,259,655 B1
(45) Date of Patent: Jul. 10, 2001

(54) ULTRADIAN TIMER

(76) Inventor: William W. Witort, 9260 SW. 14th St., Apt. 2206, Boca Raton, FL (US) 33428

( * ) Notice: Subject to any disclaimer, the term of this patent is extended or adjusted under 35 U.S.C. 154(b) by 0 days.

(21) Appl. No.: 09/358,330

(22) Filed: Jul. 21, 1999

Related U.S. Application Data

(63) Continuation-in-part of application No. 09/151,616, filed on Sep. 11, 1998, now abandoned
(60) Provisional application No. 60/058,600, filed on Sep. 12, 1997.

(51) Int. Cl.[7] ..... G04B 19/24; G04B 25/00; G04C 17/00
(52) U.S. Cl. ..... 368/28; 368/223
(58) Field of Search ..... 368/10, 28–30, 368/37–40, 76, 80, 82–84, 223, 228

(56) References Cited

U.S. PATENT DOCUMENTS

| | | | | |
|---|---|---|---|---|
| 4,059,952 | * | 11/1977 | Kaestner . | |
| 4,101,962 | * | 7/1978 | Hakata | 364/413 |
| 4,184,202 | * | 1/1980 | McCrae | 364/413 |
| 4,240,153 | * | 12/1980 | Merritt | 368/28 |
| 5,659,521 | * | 8/1997 | Amano | 368/10 |

* cited by examiner

*Primary Examiner*—Vit Miska
(74) *Attorney, Agent, or Firm*—John C. Smith

(57) ABSTRACT

A modified wrist watch that has an adjustable indicator on the face of the watch which allows an individual to tell at a glance at what point the individual is within the ultradian cycle. The watch has an adjustable indicator to synchronize the individual's personal ultradian cycle to the time on the watch. The indicator has a series of indicia arranged on the watch face to indicate when the individual is at the individual's peak biological physical/mental condition. The individual can observe when the healing cycle is approaching. By observing the individual's ultradian cycle's alignment with the time of day, activities can be planned such that proper capability is present at the right time. An alternative embodiment allows the watch face to monitor multiple ultradian cycles such that an individual can monitor the individual and a second party simultaneously for determining the best time to interact. A further embodiment provides for a computerized system that monitors multiple individuals simultaneously and which allows event scheduling based on the most productive cycle times of a group. The computer may also be used to schedule worker interactivity such that ultradian cycles do not coincide for the purpose of ensuring that at least one worker is in a fully adequate alert state at all times. The computer may also monitor errors and estimate the approximate time of the rest period for the purpose of assigning break times, or introducing challenging productive projects.

20 Claims, 9 Drawing Sheets

ULTRADIAN TIMER

CROSS-REFERENCE TO RELATED APPLICATIONS

This application is a continuation in part application related to the commonly owned copending application entitled "ULTRADIAN TIMER", filed Sep. 11, 1998, bearing U.S. Ser. No. 09/151,616 and naming William Witort now abandoned, the named inventor herein, as sole inventor, the contents of which is specifically incorporated by reference herein in its entirety. The parent application Ser. No. 09/151,616 is a continuation of provisional application No. 60/058,600 filed Sep. 12, 1997 now abandoned, entitled ULTRADIAN TIMER, and naming William Witort, the named inventor herein, as sole inventor, the contents of which is specifically incorporated by reference herein in its entirety.

BACKGROUND OF THE INVENTION

1. Technical Field

The present invention relates to timer devices which permit comparison of actual biological rhythm the performance with associated ultradian cyclical status. In particular, it relates to timing devices which allow an individual to conveniently monitor their daily ultradian cycle. The timing device is set to match the variations in the individual's ultradian cycle. Furthermore, the ultradian cycles of multiple individuals can be monitored in relation to one another to determine the best times for the individuals to interact.

2. Background Art

The human body is subject to a variety of cyclical fluctuations that affect an individual's mental and physical efficiencies. Extensive worldwide research has identified a basic ultradian rest/activity cycle (BRAC) of 90–120 minutes which regulates the amplitudes of crucial mind/body responsiveness. An approximate two hour cycle consists of a peak activity period of about 100–105 minutes and a rejuvenating period of about 15–20 minutes. This basic rest and activity pattern is gene-related and found in all forms of life.

The body requires the rejuvenation intervals to replenish stores of energy in bodily organs, and to maintain balance in brain chemistry. Repeated overriding of this rejuvenating interval seriously affects one's physical and mental performance, causing a condition labeled "Ultradian Stress Syndrome" (USS). USS can manifest a variety of physical and psychological symptoms: headaches, back problems, fatigue, memory problems, irritability, depression, and accident proneness. It would be highly advantageous to the individual and to society to adopt a means to alert individuals of their Ultradian cycles so that stress symptoms can be controlled.

The ultradian cycle reflects the need for an individual to periodically rest over the course of the day. It typically is based on an approximate two-hour long cycle. During this two-hour cycle, an individual experiences a low energy/low alertness state during a relatively short healing interval occurring in each two-hour cycle. When the healing interval is completed, the individual advances to an optimal energetic/alert state. Then, once the individual has reached the optimal level of energy and alertness, the individual's energy and alertness tends to slowly decline until it returns to the low energy/low alertness healing state of the adjacent ultradian cycles.

The ultradian cycle is associated with mind/body conditions affecting attention, learning, concentration, memory, stress and endocrine, immune, and nervous systems. In this ultradian cycle, a basic rest/activity period consisting of approximately two hours has been established. During this cycle, the mind/body requires approximately 15 to 20 minutes of restorative healing (i.e. rest) time. If adequate rest and mental relaxation is taken during this healing period, the body will function at its optimal levels of mental and physical performance throughout the ultradian cycle. Likewise, if individuals repeatedly override the healing period, they become subject to Ultradian Stress Syndrome (USS), which depresses levels of concurrent mental alertness and physical performance and may ultimately lead to health problems.

These two hour repetitive ultradian cycles of rest and activity continue throughout the twenty four hour Circadian Cycle. One way to illustrate this cycle is to graphically represent it in the form of a sine wave. The rest and rejuvenation portion corresponds to the 15–20 minute time intervals containing the lowest adjacent sine values. Performance problems occur if an individual repeatedly overrides the healing cycle by continuing to work when rest should be taken. The lack of rest induces deficit conditions that contribute to problems relating to stress, depression and fatigue. It would be desirable to have a method of indicating an individual's current status within their ultradian cycle. This would allow an individual to take appropriate measures to relax or change focus during healing intervals, thereby ensuring the ultradian cycle's return to optimum levels when in the alert state.

In addition to the need for an individual to be able to conveniently measure his or her personal ultradian cycle status, there is a need to be able to avoid problems caused by working through ultradian cycles in a group environment. For example, one individual may be in the peak performance portion of his or her ultradian cycle. A second individual may simultaneously be in a rest/rejuvenation period of the ultradian cycle. It would be advantageous to have a method of monitoring the ultradian cycles of multiple individuals such that the knowledge of those ultradian cycles could be used to the best advantage.

Depending on the activity a group of individuals are simultaneously engaged in, it may be desirable to have individuals with coincident ultradian cycles working together. For example, for individuals working in a creative process it may be best if their ultradian cycles coincide, such that both individuals are at peak performance (i.e. in the full alert state) at the same time. This may result in much more effective creative efforts from a group. On the other hand, some activities may be best served when the individuals in the group have ultradian cycles that do not coincide. For example, it would be more advantageous when a pilot and a co-pilot are flying an aircraft to have at least one of those individuals in a high-energy/high alertness state at any given time. Therefore, it would be advantageous to have a method of monitoring the ultradian cycles of multiple individuals such that the ideal matching of individuals BRAC's can be made for a particular activity.

While discovering the basic ultradian cycles and the need for periodic rest, the prior art has failed to provide a device capable of conveniently indicating to an individual their current Ultradian Cycle Status, at any particular time of day. Likewise, it would be desirable to have a method of simultaneously monitoring ultradian cycles of multiple individuals to determine the best time for those individuals to interact over the course of a day. Further, the prior art has failed to provide a device which is inexpensive to manufacture, has a minimum number of components, is convenient to use, and can be used without the burden of carrying additional complex equipment.

SUMMARY OF THE INVENTION

The present invention solves the foregoing problems by providing a modified wrist watch having, in addition to conventional watch components, an adjustable indicator on the face of the watch that allows an individual to tell, at a glance, the individual's status in their Ultradian Cycle. The watch has an adjustable indicator that can be rotated to set the individual's personal ultradian cycle status into synchrony with the current time shown on the watch. One embodiment of the indicator has a series of six sine waves arranged evenly around the center of the watch face, each sign wave representing a two-hour segment of time. When the hour hand of the watch is at the apex of the sine waves, it indicates that the individual is at the individual's peak physical/mental condition. As the hour hand of the watch approaches the low point on sine wave, the individual is approaching the healing cycle. By observing the individual's position in the ultradian cycle, the individual can adjust activities such that proper rest and mental relief can be had at the proper time. An alternative embodiment provides for a digital indication of the wearer's ultradian cycle status. Another alternative embodiment uses an indicator with a two hour polar sine plot of the Ultradian Cycle. Another embodiment provides a watch face with multiple indicators to monitor multiple ultradian cycles such that an individual can monitor the individual and a second party simultaneously for determining the best times to interact. A further embodiment provides for a computerized system that monitors multiple individuals simultaneously and which allows scheduling events based on the most productive cycle times for a particular group.

DESCRIPTION OF THE PREFERRED EMBODIMENT

Prior to a description of the figures, a general overview of the stress related problem and the solution provided by this invention is presented. Recent research has uncovered a fundamental source of chronic stress symptoms which is caused by the repeated suppression of the natural need for a period of rest and rejuvenation every two hours. Ignoring this need leads to a mixture of mind/body malfunctions. Research by the National Institute of Health, the Mount Sinai Hospital School of Medicine of New York City, NASA, Harvard Medical School, the Walter Reed Army Institute of Research Scientists, and the University of Minnesota Medical School, and Dr. Ernest L. Rossi, among others, have resulted in publications corroborating the existence of the Ultradian Cycle and its influence on human behavior. However, economic efficiency or convenience rule social activities which largely ignore the mind/bodie's natural need for restorative breaks.

The period of the ultradian cycle occurs naturally and lasts about two hours. The cycle is flexible in that its starting point can vary based on the activity or regimen of the individual. For example, when an individual changes work schedules, time zones, or gradual shifts in sleep patterns, rising, eating, or resting times, the ultradian cycle for that individual may shift. Repeated overriding of the ultradian cycle's healing period will cause hormonal imbalance which will cause irritability, hostility, and other hyperactive behaviors. Further, peak performance is adversely affected because of the depletion of reserves required by the mind/body network. Occasional overriding of rejuvenating periods generally lies within the human's adaptability to react to emergencies and temporary deficiencies.

The invention is directed to an adjustable method of measuring and monitoring an individual's ultradian cycle, which may vary on a daily basis, and inform the user of the status of the ultradian cycle during the day. By knowing when rest should be taken, based on the status data provided by the invention, the individual can perform consistently at optimum levels during the day. Alternative embodiments also allow monitoring of multiple users for improving performance in group activities, essentially providing a group's Ultradian Cycle Status. An additional embodiment monitors worker productivity and error rates to dynamically determine the presumed status of the worker's ultradian cycle. This data is then used to schedule the worker's breaks/activity at the appropriate times.

Figure 1:
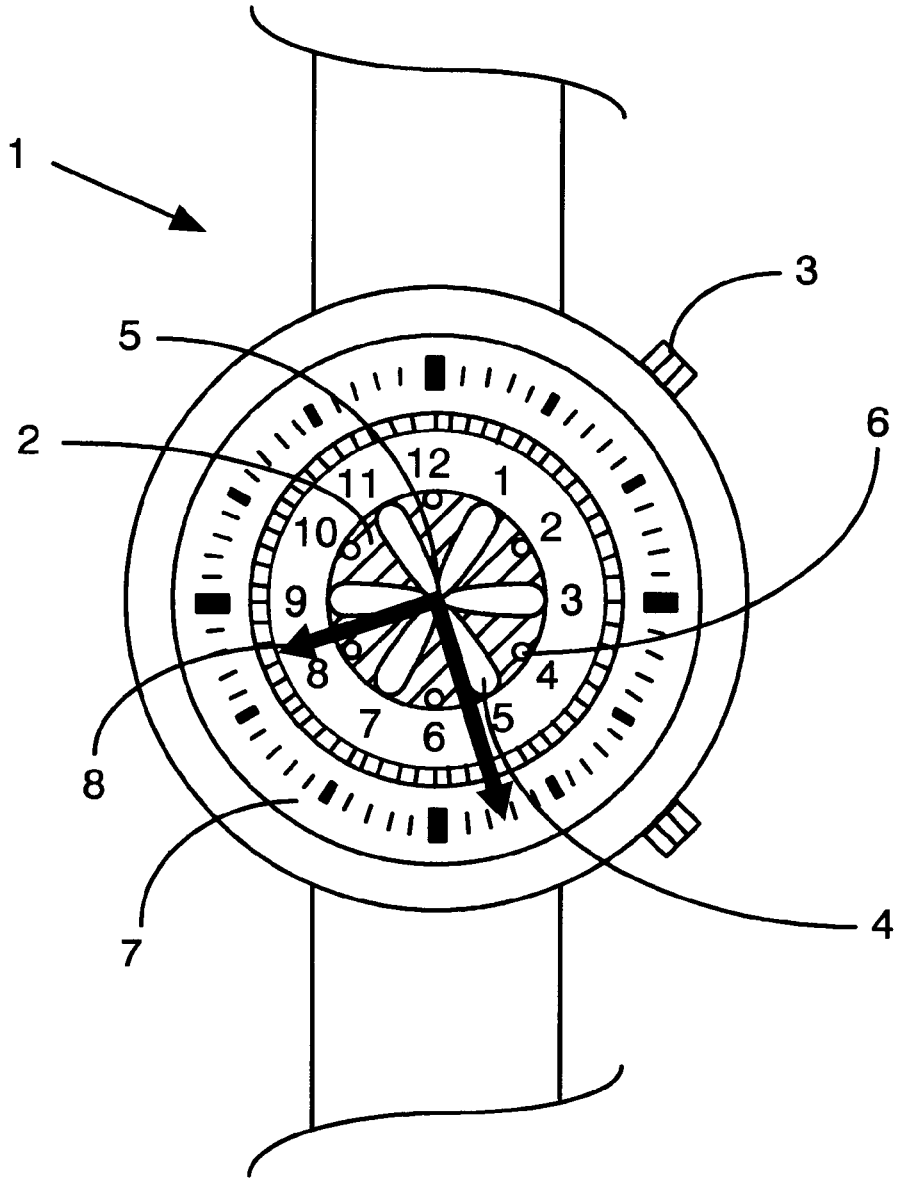
FIG. 1 is a diagram illustrating a preferred embodiment of the watch in which a rotatable calibrated petal configuration of two hour sine waves is used to indicate the ultradian cycle.

Referring to FIG. 1, this figure shows a watch 1 that has calibrated petal sine curves 4 in the center of the watch face 7. The watch face 7 includes a rotatable bezel 2 in the center of the watch face 7 which rotates about the pivot point 5 of the hour band 8. The rotatable bezel 2 is controlled by a knob 3 that is mechanically connected to the rotatable bezel 2. Since the starting point of each individual's ultradian cycle may vary from that of other individuals, the knob 3 allows the user to adjust the rotatable bezel 2 to match the user's personal ultradian cycle.

Optional index marks 6 are located at the outer edge of the rotatable bezel 2 to indicate the healing cycle midpoint. The user may adjust the rotatable bezel 2 to correspond with the inception of the user's ultradian cycle when the user normally begins the day. Over the course of the day, the user can periodically glance at the watch face 7 to confirm/determine status on the ultradian cycle. When the healing cycle is near, the user can adjust activities to allow for proper mental rest and rejuvenation. By so doing, the user will synchronize activities within the ultradian cycle and maximize performance and productivity.

Those skilled in the art will recognize that watch knobs for controlling elements of a wrist watch are well known in the art, and that any suitable method can be used to rotate the rotatable bezel 2. For example, rotatable bezel 2 can be controlled by a simple slide mechanism to allow the user to manually rotate the rotatable bezel 2 via an outside tab (not shown).

Also, those skilled in the art will recognize that the user's original estimate of the start of the ultradian cycle may be incorrect. As a result, the adjustability of the watch is important since it allows the user to modify the setting if later found to be incorrect. This may happen when the user notices an increased error rate and/or fatigue and determines that he/she is in a rest/rejuvenation period of the cycle.

Figure 2:
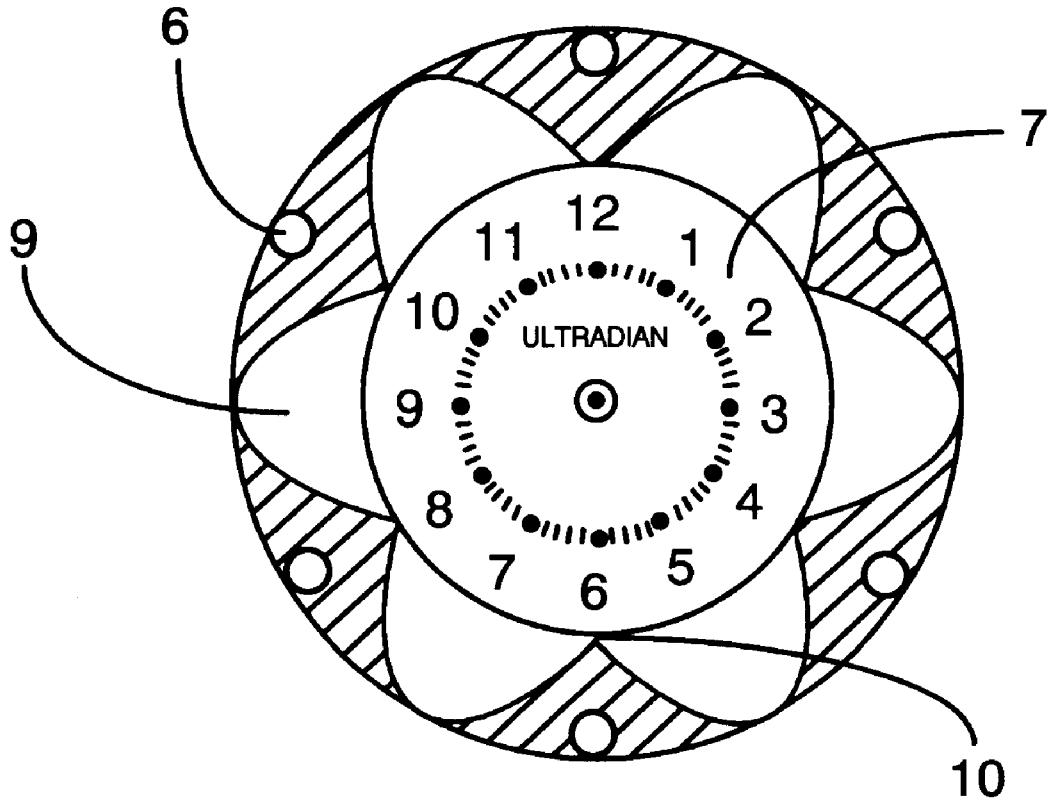
FIG. 2 is an alternative preferred embodiment of the rotatable two hour sine wave configuration in which the sine waves are plotted on the outer edge of the standard watch face.

In FIG. 2, an alternative embodiment is illustrated. In this embodiment, the two hour sine-related petal structure 4 of FIG. 1 is replaced with an open plotted sine wave display 9. The optional index marks 6, indicating the inception of the user's ultradian cycle, are also shown on this display. Likewise, the locations of the midpoint of the healing cycle are shown at the null point 10. In this figure, a conventional fixed watch face 7 is shown positioned inside the ultradian cycle indicator.

Figure 3:
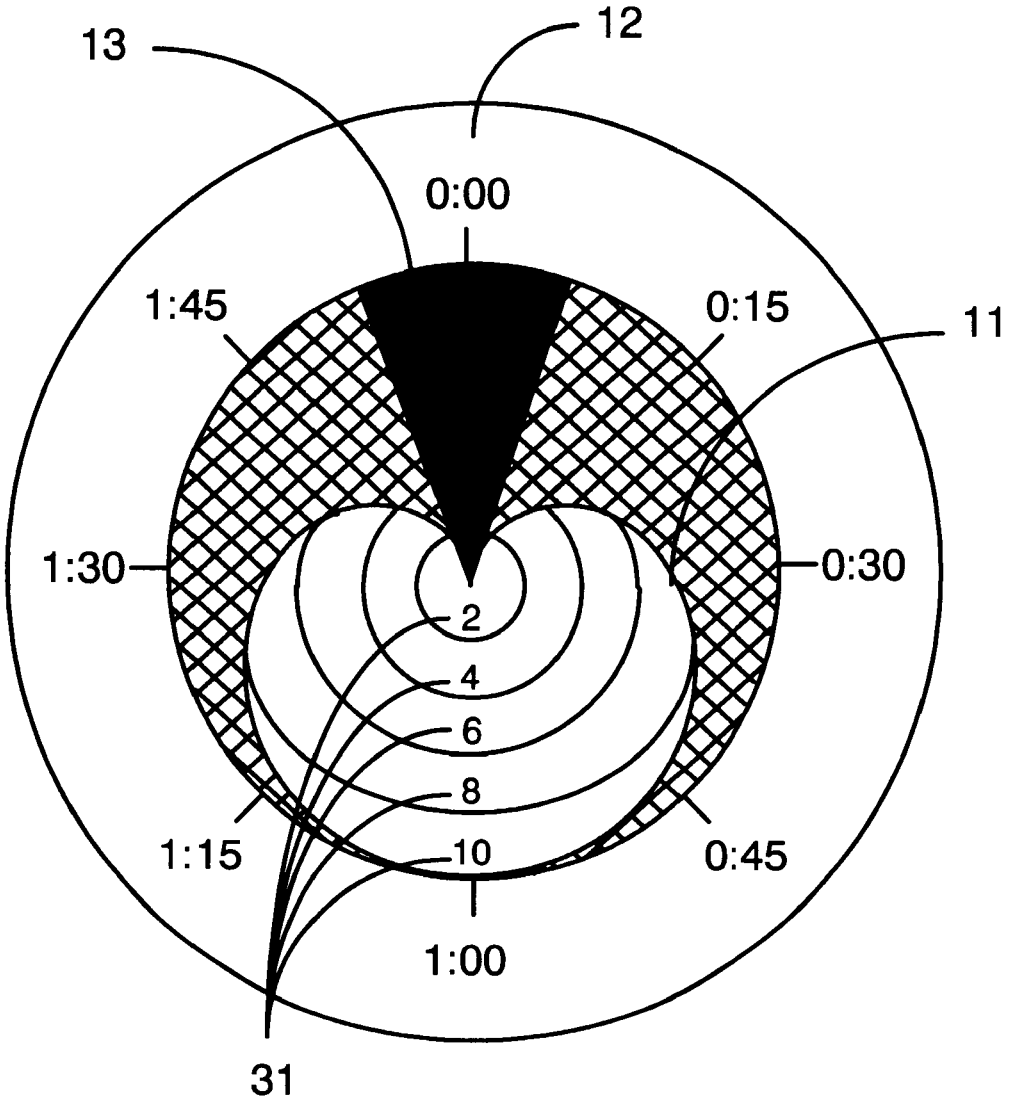
FIG. 3 is another alternative preferred embodiment of a fixed two hour calibrated polar sine plot.

FIG. 3 shows an alternative embodiment in which the petal structure 4 and the sine wave display 9 of the previous embodiments have been replaced with a polar sine plot 11 which illustrates a fixed two hour ultradian cycle. The hour hand's intersection with the arcs numbered 0–10, display 31 can be used to indicate degree (on a basis in a 0–10) of expected optimal mind/body performance. For illustrative purposes, the healing cycle midpoint 12 is located at time zero. This plot requires the hand to rotate once every two hours. Therefore, its application to a conventional wrist watch will require the use of a third hand which rotates once every two hours.

As can be seen, a variety of display designs can be used to indicate the two hour ultradian cycle. In this example, when the hand is at approximately 0:15, the ultradian cycle would be at approximately 40 percent of maximum. At approximately 35 minutes, the ultradian cycle would be at approximately 80 percent. At one hour into the cycle, the ultradian cycle would be at maximum (100 percent) a performance. As the hand proceeded to the 0:00 position, the optimum performance would decline in the reverse proportion as it advanced in the first hour.

Those skilled in the art will recognize that the implementation of any of the foregoing embodiments can be easily done with non-mechanical watch faces. For example, an LCD watch can perform all of the functions of the previous embodiments and, in fact, it can also switch electronically from one embodiment to another. In the foregoing embodiments, the displays illustrated can be made from mechanical displays or from electronic (LCD or TFT active matrix) displays. Likewise, the sine wave can be replaced with any pattern capable of indicating an individual's status in the ultradian cycle. As a result, the particular patterns used in the foregoing embodiments should be considered as illustrative only. Those skilled in the art will recognize that, in addition to is wrist watches, the invention can be implemented on any type of clock or watch face.

Figure 4:
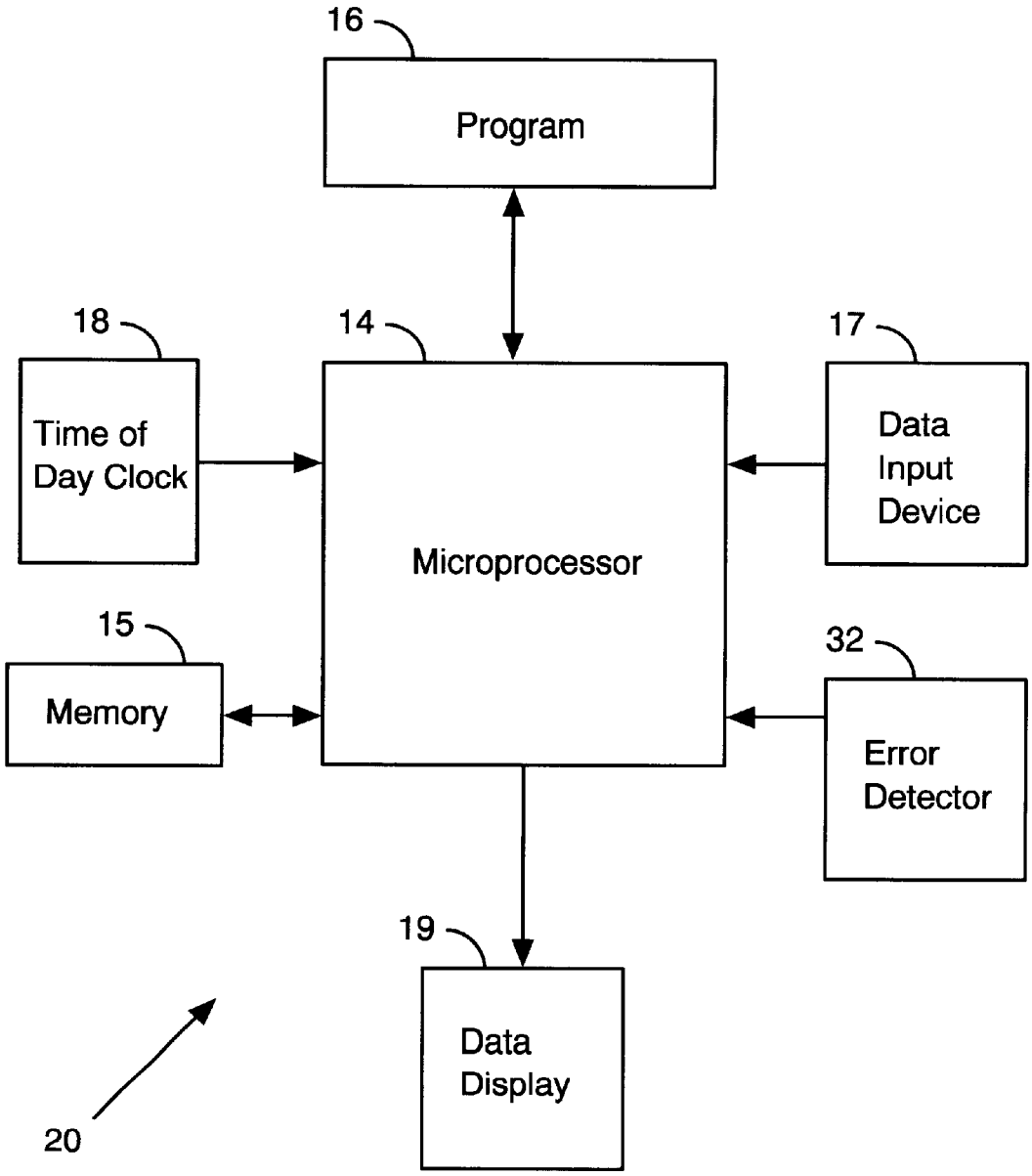
FIG. 4 is another alternative preferred embodiment which uses a computer system to monitor an individual's ultradian cycle and to display information regarding that ultradian cycle.

FIG. 4 illustrates another alternative preferred embodiment in which a computer 20 is used to monitor the ultradian cycle of an individual. The computer 20 includes a microprocessor 14 that obtains time of day data from a time of day clock 18. A data input device 17 is used to input data indicating an individual's ultradian cycle status. Data input by the user via data input device 17 is stored in memory 15. In the preferred embodiment, a software program 16 running under control of microprocessor 14 obtains the data indicating the status of the user's ultradian cycle at a particular time of day from memory 15, and in addition, software program 16 obtains the current time of day from a clock 18. The program 16 then calculates the ultradian cycle pattern for that particular user, and using the time of day data from the time of day clock 18, calculates the ultradian cycle status of the user. Program 20 establishes "correcting" types of entries and reiterations on an ultradian time graph to establish or confirm an individual's or combined group's cyclical performance characteristics.

Once the individual's or combined group's status is determined in regard to their ultradian cycle, microprocessor 14 then displays the current ultradian cycle information on the data display 19. The program can be instructed as to how often the display should be updated.

The data can be displayed in a variety of forms. For example, a simple text message can be displayed indicating the user's ultradian cycle status. Alternatively, a graphical display can be output by microprocessor 14 to data display 19 indicating the individual's current ultradian cycle status. In addition to using a graphical device, those skilled in the art will recognize that data display 19 can also be implemented as a nongraphical device such as an audio output device which would indicate to the user, via a voice message or a warning sound to the user, when the healing cycle is to begin. Results 15 can be utilized to select rest periods of individuals or workgroups which would best synchronize with the predominant healing interval.

Also shown in this figure is an optional error detection function 32. In the preferred embodiment of the error detection function 32, a software program running under control of the microprocessor 14 would monitor errors. When the error detection function 32 detected that the error rate was escalating, it would compare error rates for that worker over the course of the day. Concentrations of errors would be used to determine the approximate points of the rest periods. The computer 14 would then use this information to schedule work breaks for the worker. For example, if a worker on an automobile assembly line had work breaks scheduled in this manner, then productivity could be improved. Also, warning messages can be programmed to appear when desynchronization occurs between actual and calculated optimal performance.

Figure 5:
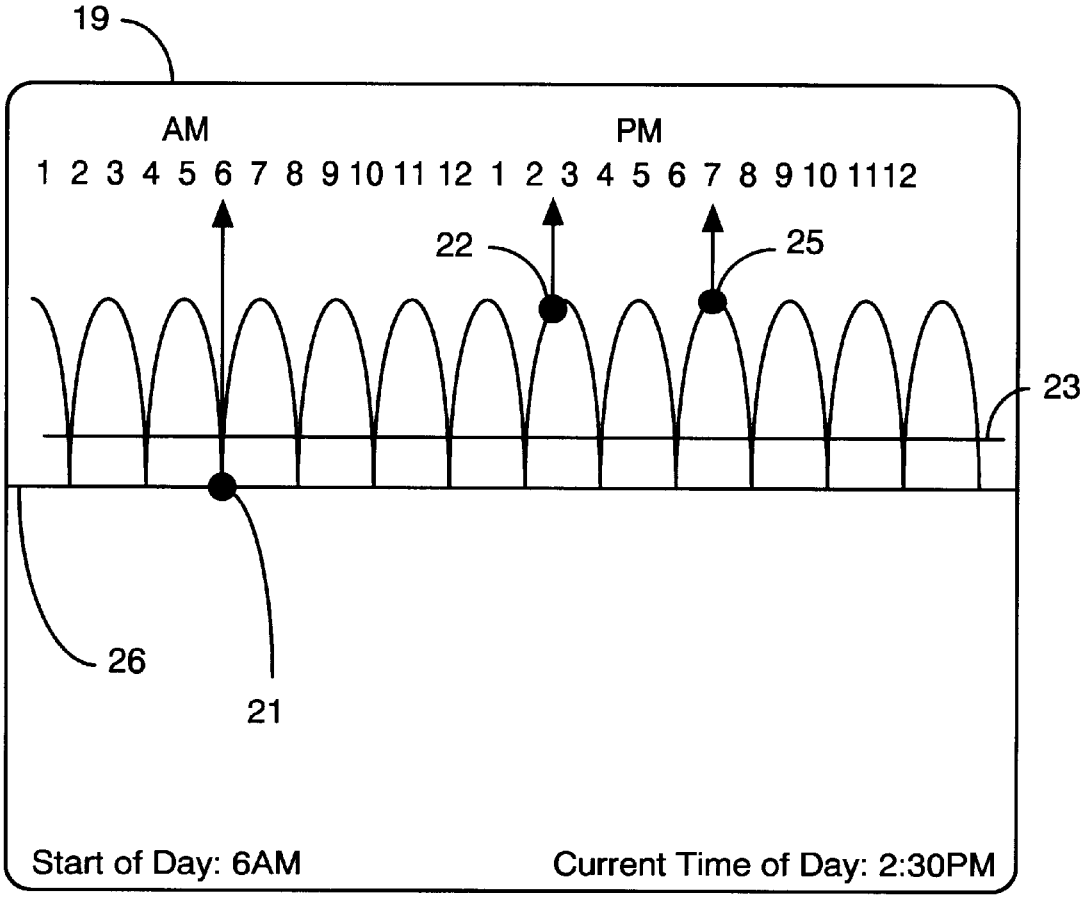
FIG. 5 is an illustrative example of a formatted display used in conjunction with the computer system of FIG. 4.

In FIG. 5, an illustrative example is given showing how the ultradian data can be displayed in conjunction with the system of FIG. 4. Data display 19 can display the ultradian cycles of an individual for entire day. On the upper portion of the display the hourly times are illustrated in one-hour increments beginning at 1 a.m. and ending at 12 p.m. Also shown at the bottom of the display screen is the start time of the individual's day, which is indicated as 6 a.m. This would normally be the time of day that the user wakes up. This time would be input to the microprocessor 14 by the user via data input 17 (which may be any convenient device such as a keyboard, a mouse input, voice input, etc.). Also shown on the display screen is the current time of day which is indicated to be 2:30 p.m. The time of day data is obtained from the time of day clock 18 by microprocessor 14.

Line 25 indicates the lowest point of the rest period. The area below line 23 represents the time when the individual is in the rest portion of the individual's ultradian cycle. When the individual wakes up, in this case at 6 a.m., the individual is recovering from a low point of the ultradian cycle. This is illustrated by dot 21. As the individual goes through the day, the individual will go through a cycle every two hours. The ultradian cycle is defined for purposes of discussion as the two-hour period from low point to low point in the ultradian cycle.

The computer can indicate where the individual is, in regard to the ultradian cycle, by indicating a current time of day in relation to the sine wave. In this illustration, a dot 22 is drawn at the current time of day which is 2:30 p.m. For ease of illustration, an arrow is shown extending from the sine wave to the time indicator at the top of the screen. As can be seen, at this point in time the individual is in the high-energy/alert state. By way of further illustration, the individual can tell from the data display 19 that at approximately 7:00 p.m. the individual will be in the peak activity period of the ultradian cycle.

Figure 6:
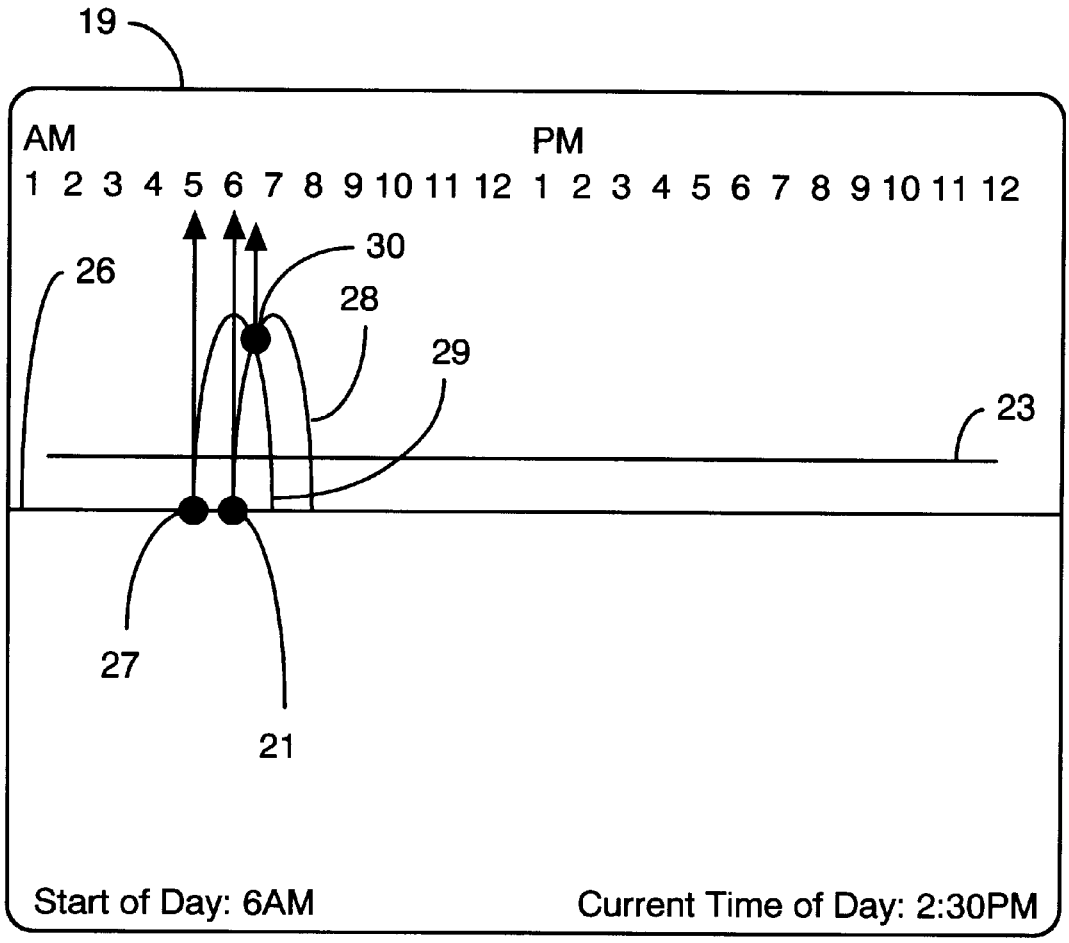
FIG. 6 is an example of a formatted display used in conjunction with the computer system of FIG. 4 in which the ultradian cycles of two individuals are simultaneously monitored.

In FIG. 6, an alternative preferred embodiment is shown in which the ultradian cycles of two individuals are simultaneously displayed. For ease of illustration only a single period of the ultradian cycle for each individual is shown. Ultradian cycle 28 is the same cycle discussed above in regard to FIG. 5. As was the case above, the individual represented by ultradian cycle 28 woke up at 6 a.m. as represented by dot 21. The second individual, who is represented by ultradian cycle 29 woke up at 5 a.m. as represented by dot 27. An advantage of simultaneously monitoring the ultradian cycles of two individuals is that the computer display 19 can readily identify and display the optimal time for both individuals to interact. In this example, the point at which the individuals are at their highest combined optimal levels is at approximately 6:30 a.m. as represented by dot 30. By using the computer 20 (shown in FIG. 4), a window of time can be identified in which both individuals will be in a high-energy/alert state. As a result, the computer 20 can be used as an effective tool to identify time periods in which multiple individuals should interact.

The computer program 16 (shown in FIG. 4) can also include other functions. For example, instead of merely calculating and displaying the ultradian cycles of individuals, the program 16 can also include other functions such as a daily task scheduler. If the ultradian cycle monitoring is incorporated into a daily task scheduler, the program 16 can then automatically take into account the position of an individual in that individual's ultradian cycle when the program 16 is scheduling meetings. By merging ultradian cycle monitoring into software activity schedulers, the user can more effectively schedule appointments by having the computer 20 automatically indicate the best times to set an appointment. This can provide very beneficial results when the individual is scheduling an important meeting. For example, a salesman would want to know when his peak performance period occurs in order to have the best possible chance of closing a sale. Likewise, it would be advantageous to know when the most desirable high-performance/alertness times dominate when scheduling the negotiation of an important matter. During a negotiation, having a portable device, such as a watch, capable of displaying the wearer's ultradian cycle status can be very useful by allowing the wearer to monitor his ultradian status.

Computer 20 also allows the best time for a worker to take a break to be automatically determined by the computer system. In manufacturing environments, computer 20 are often available on assembly lines to monitor and control the assembly process. It would be desirable to incorporate ultradian cycle timing into the manufacturing process such that workers were given the opportunity to take a break from work in the time periods when they most need it. This will make the worker more efficient and potentially reduce job related injuries by eliminating accidents caused by workers who are repeatedly working through their rest cycle.

An additional advantage associated with the use of computers in relation to ultradian cycle monitoring is that the computer can be used to determine the most opportune time for group activities. This can be particularly advantageous when scheduling activities where important decisions need to be made. Sometimes it is advantageous to adjust schedules such that ultradian cycles do not correspond between workers. As noted above, an example of this kind of group scheduling is the use of computers to select members of a flight crew such that their ultradian cycles do not entirely coincide. By so doing, the situation is avoided where all of the flight crew is in minimum optimum performance status at the same time. At least one or more of the flight crew can be in the alert state at all times through selection of crew members based on ultradian cycle plots.

Figure 7:
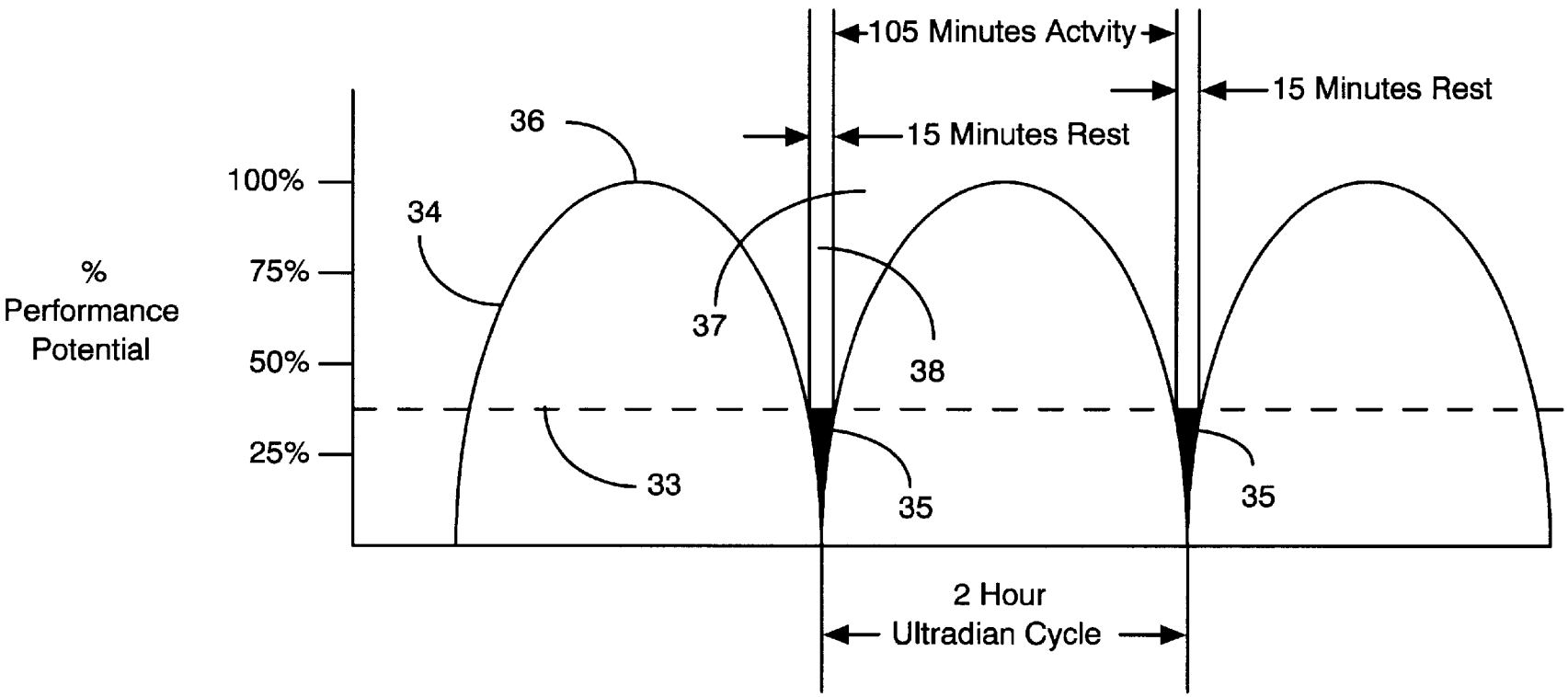
FIG. 7 is another illustration of the basic rest/activity cycle (BRAC) which uses a sine wave to illustrate the percentage of performance potential of an individual during the course of the BRAC.

FIG. 7 illustrates the basic rest/activity cycle (BRAC). The BRAC, which is also known as the ultradian cycle, is illustrated in this figure as a sine wave 34. The peak 36 of the sine wave 34 represents 100 percent of the performance potential of an individual. Likewise, the trough 35 of the sine wave represents the minimum potential of an individual which occurs in the rest period 38 of the BRAC. As can be seen in this figure, the two-hour ultradian cycle includes approximately a 15 minute rest period 38 and a 105 minute activity period 37. During the 15 minute rest period 38, the user's performance potential is at a low point. In the figure, this is illustrated by the area under dashed line 33.

It is important to note that activities and rest (or the lack of rest) during one BRAC can have an effect on subsequent BRAC's. For example, when an individual continually overrides the rest cycle, the repeated failure to take periodic rests will result in contraction of the sine wave such that the peaks and valleys are closer together. In turn, this results in the user not being able to reach 100 percent optimum performance in subsequent BRAC cycles due to fatigue. When a worker continuously overrides the need to take rests, due to work schedules, etc., the worker will perform at lower efficiency and make more mistakes. This is a disadvantage to the employer since employee productivity is reduced and may have an adverse effect on product quality and cost.

Figure 8:
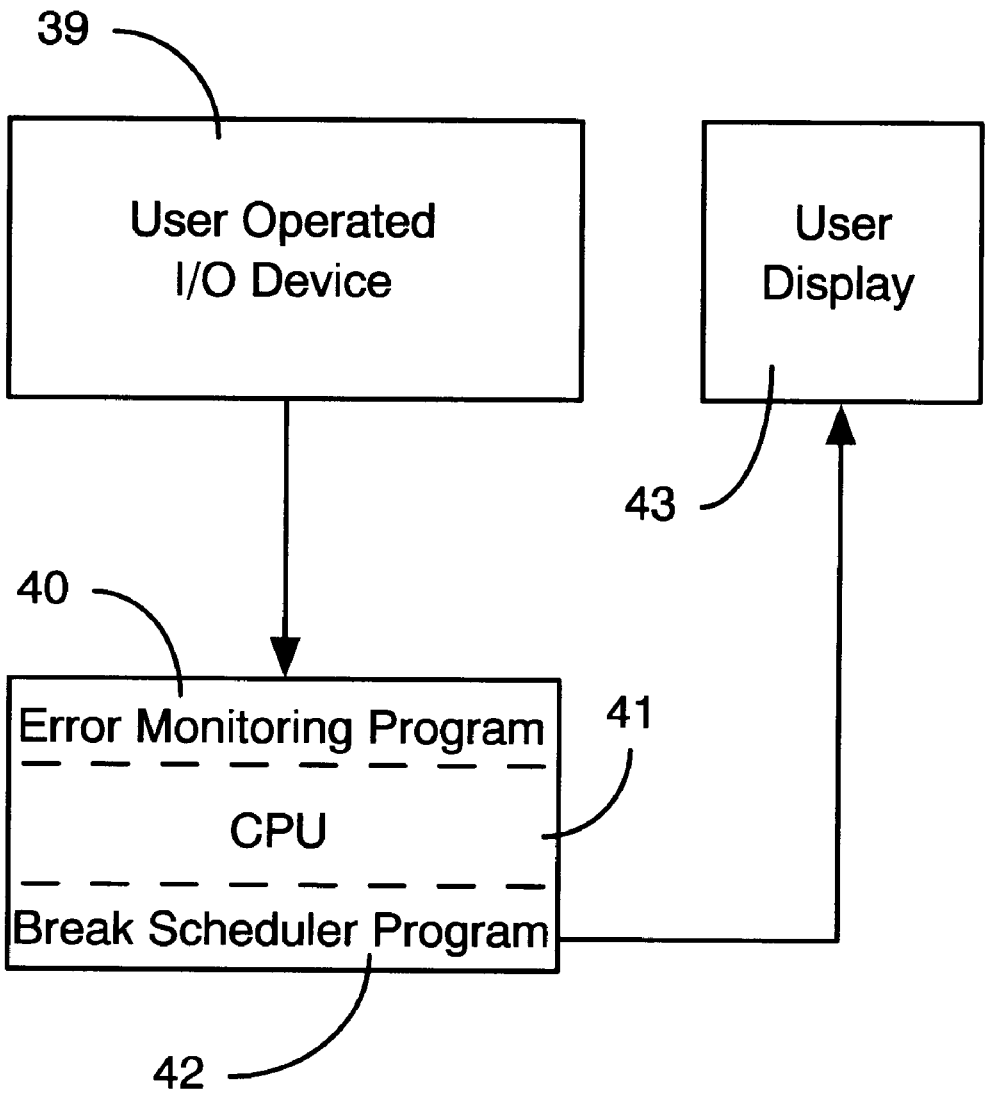
FIG. 8 illustrates a computer controlled system which dynamically monitors user performance to determine by assessing iterative corrections, when a user is apparently working during a healing cycle. The computer then schedules rest periods for the user to coincide with the rest period.

FIG. 8 is an alternative preferred embodiment which illustrates how to use a computer to dynamically monitor user performance and to schedule user work activities. In this embodiment, a user controlled I/O device 39 is monitored by an error monitoring program 40 under control of the computer's CPU 41. When the error monitoring program 40 detects changes in the user's performance, it uses those detected changes to determine when that user is entering a healing cycle period. The changes in the user's performance may take the form of increased error rates, a slowdown in productivity, or a combination of both.

Once the computer has determined the probable rest period time for that user, it then schedules work breaks for the user to coincide with the rest periods. The work breaks are scheduled by a break scheduler program 42 which is also controlled by CPU 41. The data output by the error monitoring program 40 is used as input by the break scheduler program 42. Of course, error monitoring program 40 and break scheduler program 42 may be incorporated into the same software program. The user is notified of the break schedule via user display 43 which may be any suitable I/O device for the purpose.

The ability to dynamically monitor worker performance, and in turn to dynamically schedule worker rest times will benefit both the worker and the employer.

The worker benefits by being allowed to rest at the proper time. Because the worker will be more productive he becomes more valuable to the employer. In addition, if the worker is operating equipment which may be dangerous, scheduling the worker's breaks at the proper time will avoid accidents that may be caused by the worker attempting to perform complex operations during his lowest performance potential.

The employer benefits by having reduced error rates which may result in fewer rejected parts, fewer injuries, and higher productivity levels. As a result, both the employer and the employee benefit from an awareness of the need to take rest at appropriate times. The use of a computerized monitoring system allows the automated monitoring of worker performance and scheduling work breaks at the appropriate times with minimal user activity required.

In some occupations, such as piloting, errors which may result from working through a rest period may have disastrous consequences. Therefore, the automated monitoring system described in regard to FIG. 8 may have substantially increased value.

Figure 9:
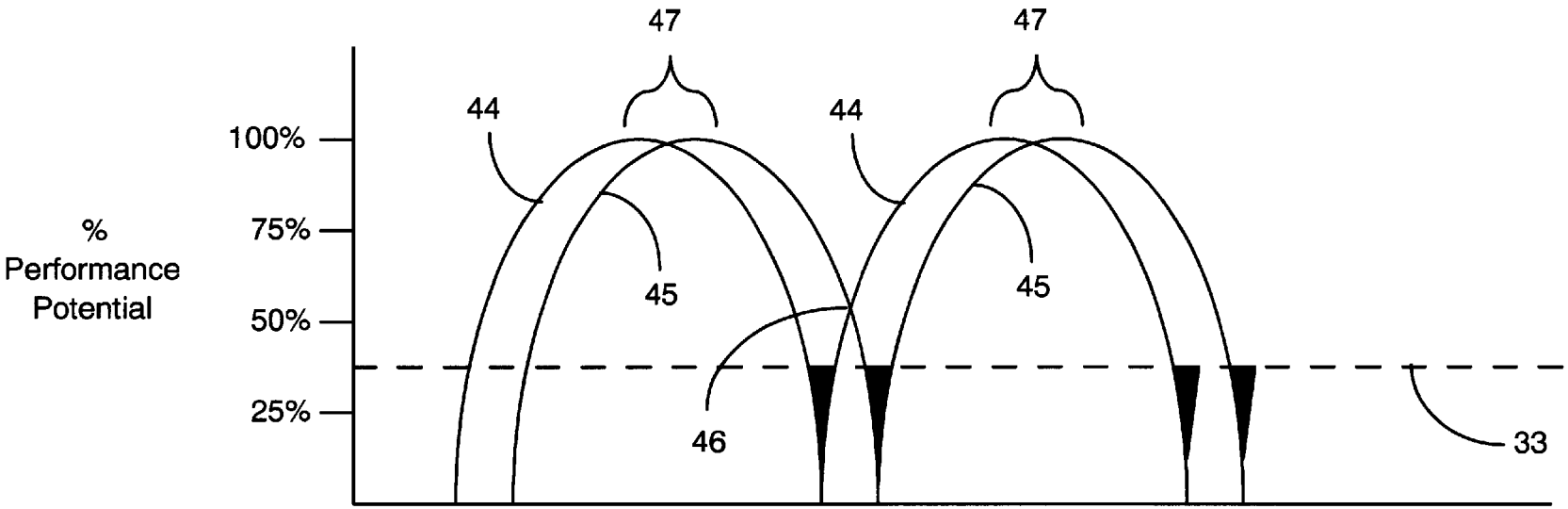
FIG. 9 is a graph that illustrates overlapping BRAC's of two individuals.

FIG. 9 is a graph which illustrates a display of overlapping BRAC's of two individuals. The first individual's BRAC 44 and the second individual's BRAC 45 are shown offset because their individual ultradian cycles begin at different times of day. In area 47 both individuals are near the top of their performance potential. At this point in time, the employees will be most efficient when acting together. At intersection 46 the two individuals will be at combined minimum efficiency (50 percent potential).

In a manufacturing environment, workers often rely on one another as part of a manufacturing process. The advantage of using a computer controlled monitoring system or even a watch-based manual system is that the users can coordinate break times to avoid situations when users work through their rest periods.

While the invention has been described with respect to a preferred embodiment thereof, it will be understood by those skilled in the art that various changes in detail may be made therein without departing from the spirit, scope, and teaching of the invention. For example, the display can be any suitable format such as a sine based indicator, a petal structure, a timed audio signal, etc., the size, shape or color of the display can vary on the watch face. The adjustment/setting method can also vary. Continuing research will undoubtedly discover more accurate means of healing cycle determination through biomedically reliable means. Also, extensive use and adoption of feasible controls made possible by this invention will greatly enhance society's interactive creativity and corporate endeavors, and introduce lifestyles that can ensure increased health and emotional well-being on a worldwide basis. Multiple users can be simultaneously monitored either by reference to a watch face, by program telecommunications, by calculating device, or by computer applications. A variety of scheduling methods can be used by computers to monitor and schedule individual's work schedules and appointments such that multiple users can effectively work together by either scheduling alert states simultaneously, or in the alternative, intentionally scheduling worker activity such that ultradian cycles do not match. Accordingly, the invention herein disclosed is to be limited only as specified in the following claims.

I claim:

1. An apparatus for monitoring the ultradian cycles of an individual, further comprising:

a timer for indicating current time; and an indicator having means to adjustably set, in relation to the current time displayed on the timer, the status of the ultradian cycle for at least one individual, and further having means to indicate to the individual the position of that individual within the ultradian cycle during the day, based on the status set by the individual, the indicator further having means to display whether the individual is in an active/alert state or in a rest state;

whereby the individual can adjust the start time of the ultradian cycle each day and monitor the individual's ultradian cycle over the course of the day.

2. An apparatus, as in claim 1, wherein:

the timer is a wrist watch;

the wrist watch includes adjustable means for an individual to set the start time of the ultradian cycle at a selectable time each day; and the face of the wrist watch includes a display to indicate the current status of the ultradian cycle.

3. An apparatus, as in claim 2, wherein the ultradian cycle is displayed in on the face of the wrist watch as a sine wave.

4. An apparatus, as in claim 3, further comprising:

the wrist watch includes a second adjustable means for a second individual to set the status of the ultradian cycle for the second individual; and the face of the wrist watch includes a second display to indicate the current status of the ultradian cycle of the second individual.

5. An apparatus, as in claim 1, further comprising:

a computer, further comprising:

data input means for inputting the starting status of the ultradian cycle;

means to obtain the current time day from the timer;

memory for storing the starting status of the ultradian cycle, and for storing the time of day, obtained from the timer, when the status was input;

means to determine, during the course of the day, the current status of the ultradian cycle based on the time of day that the starting status was input;

a data display to display the current status of the ultradian cycle;

whereby the computer monitors the ultradian cycle of an individual and displays its current status on the data display.

6. An apparatus, as in claim 5, further comprising:

the data input means further providing means to input the ultradian cycle start time of a plurality of individuals;

the memory further having means to store the ultradian cycle start time of the plurality of individuals;

the computer having means to determine the current status of the ultradian cycles of the individuals; and the data display having means to display the status of the ultradian cycles of the plurality of individuals.

7. An apparatus, as in claim 6, wherein the ultradian cycle status of at least two individuals is concurrently displayed by the dated display.

8. An apparatus, as in claim 5, further comprising a scheduler for scheduling activities for individuals based on the status of that individual's ultradian cycle.

9. An apparatus, as in claim 7, further comprising a scheduler for scheduling meetings for multiple individuals based on the status of the ultradian cycles of those individuals.

10. An apparatus, as in claim 5, further comprising:

means to measure worker performance;

means to determine the status of the ultradian cycle of a worker based on the worker's performance; and a scheduler for scheduling work schedules of individuals in a manufacturing environment based on the status of the ultradian cycles of those individuals such that the worker's break time is scheduled during an ultradian cycle rest period;

whereby individual work schedules for manufacturing workers can be dynamically scheduled by computer to accommodate the ultradian cycle rest period of the individual manufacturing workers' ultradian cycles.

11. A method of monitoring the ultradian cycles of individuals, including the steps of:

inputting the start time of the ultradian cycle for at least one individual at the beginning of each day; and indicating to the individual whether the individual is in an active/alert state or in a rest state;

whereby the individual can adjust the start time of the ultradian cycle each day and monitor the current status of the individual's ultradian cycle over the course of the day.

12. A method, as in claim 11, including the additional steps of:

using a wrist watch as the indicator;

using adjustable means in the wrist watch to set the start time of the ultradian cycle each day; and displaying on the face of the wrist watch the current status of the ultradian cycle based on the start time.

13. A method, as in claim 12, including the additional step of display the ultradian cycle on the face of the wrist watch in the form of a sine wave.

14. A method, as in claim 13, including the additional steps of:

adding a second adjustable means to a wrist watch to allow a second individual to set the start time of the ultradian cycle for the second individual; and displaying on the face of the wrist watch the current status of the ultradian cycle of the second individual based on the start time of the second individual.

15. A method, as in claim 11, including the additional steps of:

using a computer to determine the status of the ultradian cycle of an individual, including the additional steps of:

inputting the start time of the ultradian cycle for the current day;

storing the start time in memory;

determining the time of day;

determining the current status of the ultradian cycle based on the input start time and the time of day;

displaying the current status of the ultradian cycle on a data display;

whereby the computer monitors the ultradian cycle of individual and displays its status on the data display.

16. A method, as in claim 15, including the additional steps of:

inputting the ultradian cycle start time of at least one additional individual;

storing the ultradian cycle start times of additional individuals in memory;

determining the status of the ultradian cycles of the additional individuals; and displaying the status of the ultradian cycles of the additional individuals on a data display.

17. A method, as in claim 16, including the additional step of concurrently displaying the ultradian cycle status of multiple individuals.

18. A method, as in claim 15, including the additional step of scheduling activities for individuals based on the status of that individual's ultradian cycle.

19. A method, as in claim 17, including the additional step of scheduling meetings for multiple individuals based on the status of the ultradian cycles of those individuals.

20. A method, as in claim 15, including the additional steps of:

measuring worker performance;

determining the status of the ultradian cycle of a worker based the worker's performance; and scheduling work schedules of individuals in a manufacturing environment based on the status of the ultradian cycles of those individuals such that the worker's break time is scheduled during an ultradian cycle rest period;

whereby individual work schedules for manufacturing workers can be dynamically scheduled by computer to accommodate the ultradian cycle rest period of the individual manufacturing worker's ultradian cycles.

* * * * *